US009162800B2

(12) United States Patent
Frenzel et al.

(10) Patent No.: US 9,162,800 B2
(45) Date of Patent: Oct. 20, 2015

(54) DEVICE FOR PROVIDING DRINKABLE LIQUIDS

(71) Applicant: QAS-COMPANY AG, Munich (DE)

(72) Inventors: Michael Frenzel, Gauting (DE); Robert Ritter, Berg (DE)

(73) Assignee: QAS-Company AG, Munich (DE)

( * ) Notice: Subject to any disclaimer, the term of this patent is extended or adjusted under 35 U.S.C. 154(b) by 0 days.

(21) Appl. No.: 13/928,948

(22) Filed: Jun. 27, 2013

(65) Prior Publication Data

US 2013/0306654 A1 Nov. 21, 2013

Related U.S. Application Data

(63) Continuation of application No. PCT/EP2011/074039, filed on Dec. 23, 2011.

(30) Foreign Application Priority Data

Dec. 30, 2010 (DE) ..... 10 2010 056 556

(51) Int. Cl.
*B63C 11/02* (2006.01)
*B65D 33/00* (2006.01)

(52) U.S. Cl.
CPC ..... *B65D 33/00* (2013.01); *B63C 11/02* (2013.01)

(58) Field of Classification Search
CPC ..... B65D 33/00; B63C 11/02
USPC ..... 220/529, 723; 405/186; 128/202.15, 128/DIG. 12; 138/30; 222/95, 105, 386.5
See application file for complete search history.

(56) References Cited

U.S. PATENT DOCUMENTS

| | | | |
|---|---|---|---|
| 2,804,995 | A | 9/1957 | Fee |
| 4,337,769 | A | 7/1982 | Olson |
| 4,398,533 | A | 8/1983 | Barker |

(Continued)

FOREIGN PATENT DOCUMENTS

| | | | |
|---|---|---|---|
| GB | 2209056 | A | 4/1989 |
| JP | 61188295 | A | 8/1986 |
| JP | 2004141455 | A | 5/2004 |

OTHER PUBLICATIONS

Geigerrig "Hydration Packs with In-Line Water Filters and Pack Bladders." Retrieved on Nov. 21, 2013 located at http://www.geiger-rig.com/ 5 Pages.

(Continued)

*Primary Examiner* — Fenn Mathew
*Assistant Examiner* — Elizabeth Volz
(74) *Attorney, Agent, or Firm* — Eschweiler & Associates, LLC

(57) ABSTRACT

A device includes a pressure container, a pressure reducer, and a valve. The pressure container contains a liquid container deformable under pressure. The pressure reducer provides a liquid which bears with a first (e.g., lower) pressure against a first connector of the pressure reducer and with a second (e.g., higher) pressure at a second connector of the pressure reducer. The first connector is connectable to the liquid container, and the second connector is accessible from outside the pressure container. Due to the pressure reducer, liquid from the liquid container can be provided with a second pressure at the second connector. The valve adds a gas to at least part of the interior space of the pressure container remaining after receipt of the liquid container, the gas having an overpressure, such that a liquid in the liquid container bears with the first pressure against the first connector.

17 Claims, 11 Drawing Sheets

(56) References Cited

U.S. PATENT DOCUMENTS

| | | | | |
|---|---|---|---|---|
| 5,389,024 | A * | 2/1995 | Chen | 441/88 |
| 5,524,612 | A * | 6/1996 | Chen | 128/202.15 |
| 6,446,628 | B1 | 9/2002 | Chen | |
| 6,758,213 | B1 | 7/2004 | Brekken | |
| 2005/0072422 | A1 * | 4/2005 | Wolfe et al. | 128/202.15 |
| 2006/0124129 | A1 | 6/2006 | Wharton et al. | |

OTHER PUBLICATIONS

Geigerrig "Hydration Packs." Retrieved on Nov. 21, 2013 located at http://www.geigerrig.com/hydration-packs.html 3 Pages.

International Search Report dated Apr. 4, 2012 for International Application No. PCT/EP2011/074039. 2 Pages.

* cited by examiner

DEVICE FOR PROVIDING DRINKABLE LIQUIDS

REFERENCE TO RELATED APPLICATIONS

This application is a continuation of International application number PCT/EP2011/074039 filed on Dec. 23, 2011, which claims priority to German application number 10 2010 056 556.3 filed on Dec. 30, 2010.

DESCRIPTION

Exemplary embodiments according to the disclosure concern drinking containers for use underwater and in particular to a device and a method for providing drinkable liquids.

Both for professional divers and recreational divers, a supply of liquid, particularly during long diving sessions, is very important, since dehydration may easily occur. Due to the limitation of movement underwater and possible mixing with the surrounding salt water or fresh water, the use of conventional drinking bottles is extremely difficult.

One example of conventional drinking bottles that can be used underwater is constituted by deformable plastic drinking bladders, wherein the liquid is pressed via a tube into the diver's mouth as he applies pressure manually using his hands. This is a difficult operation to carry out underwater however.

The object of the present disclosure is to create a device for providing drinkable liquids, which enables easy handling.

An exemplary embodiment according to the disclosure creates a device for providing a drinkable liquid, the device comprising a pressure container, a pressure reducer, and a valve. The pressure container is configured to contain in an interior space a liquid container that is deformable under pressure. The pressure reducer is configured to provide a liquid which bears with a first pressure against a first connector of the pressure reducer with a second pressure at a second connector of the pressure reducer. Here, the first pressure is higher than the second pressure. Furthermore, the pressure reducer is arranged such that the first connector of the pressure reducer is connectable to a liquid container, which is deformable under pressure, in the interior space of the pressure container, and the second connector of the pressure reducer is accessible from outside the pressure container. The valve makes it possible to fill with a gas at least part of a part of the interior space of the pressure container remaining after receipt of a liquid container deformable under pressure, the gas having an overpressure, such that a liquid in a liquid container deformable under pressure bears with the first pressure against the pressure reducer.

A further exemplary embodiment according to the disclosure creates a device for providing a drinkable liquid underwater, the device comprising a liquid container and a pressure reducer. The liquid container consists at least in part of elastic material and is configured to be filled with a drinkable liquid, such that the elastic material of the liquid container is expanded. The pressure reducer is configured to provide a liquid which bears with a first pressure against a first connector of the pressure reducer with a second pressure at a second connector of the pressure reducer. Here, the first pressure is higher than the second pressure. Furthermore, the liquid container is connected by means of an opening to the first connector of the pressure reducer, and the liquid container is configured to provide a drinkable liquid, in an expanded state of the elastic material, with the first pressure at the first connector of the pressure reducer.

A concept of the present disclosure is to pressurize a deformable liquid container or the liquid in a deformable liquid container and to then reduce this pressure by means of a pressure reducer to such an extent that, for example, a diver underwater can ingest liquid at a comfortable rate. Provided the pressure that acts on the liquid in the liquid container is greater than the desired pressure at which the liquid is to be provided, the liquid can be provided at constant or practically constant pressure by means of a pressure reducer. This corresponds to a provision of the liquid at a constant or practically constant flow rate. The user, for example a diver, can then ingest liquid very easily, since the liquid is provided at constant pressure, without the diver having to take care of this himself by applying pressure manually with his hands. The handling of the drinking container can thus be considerably facilitated, particularly underwater.

Some exemplary embodiments according to the disclosure comprise a heat-insulating layer between an outer wall of the pressure container and a part of the interior space of the pressure container provided to contain a liquid container. Warm drinkable liquids can thus be kept warm for longer. In particular underwater, warm liquids otherwise cool very quickly.

In some further exemplary embodiments according to the disclosure, the second pressure is less than 0.4 bar and/or the first pressure is greater than 2 bar.

BRIEF DESCRIPTION OF THE DRAWINGS

Exemplary embodiments according to the disclosure will be explained in greater detail hereinafter with reference to the accompanying figures, in which.

DETAILED DESCRIPTION

Like reference signs will sometimes be used hereinafter for objects and functional units that have identical or similar functional properties. Furthermore, optional features in the various exemplary embodiments can be combined with one another or can be replaced by one another.

Furthermore, references to a pressure hereinafter relate to a pressure above atmospheric pressure of approximately 1 bar. The term "overpressure" is to be understood here to mean a pressure that is higher than atmospheric pressure. In conjunction with the description of exemplary embodiments, the device for providing drinkable liquids will also be referred to as a drinking container for short.

Figure 1A:
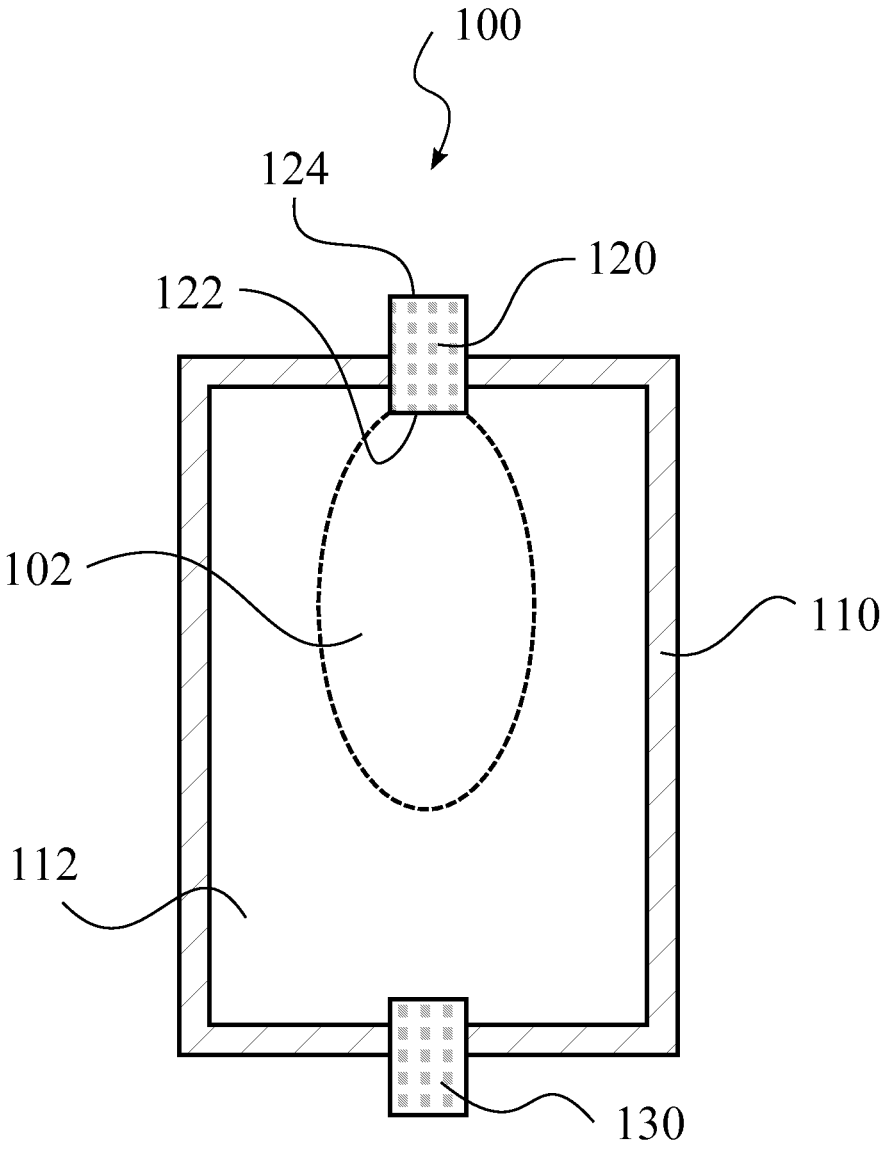
FIG. 1*a* shows a schematic cross section of a device for providing drinkable liquids.

FIG. 1 shows a device for providing drinkable liquids corresponding to an exemplary embodiment according to the disclosure. The device 100 comprises a pressure container 110, a pressure reducer 120, and a valve 130. The pressure reducer 120 and the valve 130 are formed as bushings through the wall of the pressure container 110, such that the pressure reducer 120 and the valve 130 each comprise a connector in the interior space 112 of the pressure 110 and a connector outside the pressure container 110. The pressure container 110 may contain a liquid container 102 deformable under pressure. The pressure reducer 110 provides a liquid which bears with a first pressure against a first connector 122 of the pressure reducer 120 with a second pressure at a second connector 124 of the pressure reducer. Here, the first pressure is higher than the second pressure. The pressure reducer 120 is arranged such that the first connector 122 of the pressure reducer 120 is connectable to a liquid container 102, which is deformable under pressure, in the interior space 112 of the pressure container 110, and the second connector 124 of the pressure reducer 120 is accessible from outside the pressure container. Due to the pressure reducer 120, liquid from a liquid container 102, the liquid bearing with a high first pressure against the first connector 122 of the pressure reducer 120, can thus be provided with a lower second pressure against the second connector 124 of the pressure reducer 120. The valve 130 is used to fill with a gas at least part of a part of the interior space 112 of the pressure container 110 remaining after receipt of a liquid container 102 deformable under pressure, the gas having an overpressure, such that a liquid in a liquid container 102 deformable under pressure bears with the first pressure against the first connector 122 of the pressure reducer 120.

By filling the remaining part of the interior space 112 or part of the remaining part of the interior space 112 with a gas having overpressure, a pressure can be exerted onto the deformable liquid container 102 and thus onto the liquid in the liquid container 102. Due to the pressure reducer 120, this liquid can be provided practically independently of the pressure within the pressure container. On the one hand, a user therefore does not himself have to manually pressurize the liquid container 102 by applying pressure with his hands in order to obtain liquid from the liquid container, and on the other hand the liquid also is not provided at excessively high pressure, whereby the liquid would only be drinkable with greater difficulty or would not be drinkable at all. Due to the described device 100, a simple possibility is thus provided for comfortably providing liquid, in particular also underwater. For example, an easy-to-handle drinking container for use underwater can thus be created. A device according to the described concept cannot only be used underwater however. For example, cyclists or mountain climbers may also benefit from the fact that they are provided with drinkable liquid in such a simple manner.

The pressure container 110 is configured to be externally pressure-tight for an overpressure produced from within by the filling with the gas, and also watertight. The pressure reducer 120 and the valve 130 are accordingly also integrated into the pressure container 110 in a pressure-tight manner.

The pressure container 110 can be implemented such that a liquid container 102 deformable under pressure can be contained exchangeably. In other words, the pressure container 110 may be formed in a number of parts, such that it can be opened and a liquid container 102 can be introduced and connected to the pressure reducer 110. In this case, the pressure container 110 can be closed again reversibly in a pressure-tight manner. In this example, the liquid container 102 deformable under pressure for example is an exchangeable disposable drinking container and therefore is not part of the device 100. Alternatively, the liquid container 102 deformable under pressure may also be configured so as not to be exchangeable or at least so as to be useable a number of times (refillable) and can be part of the device 100. The pressure container 110 may then also be formed in one piece for example.

The pressure container 110 is at least large enough such that there is enough space therein for the liquid container 102 deformable under pressure. For example, the pressure container 110 may be configured to contain a liquid container 102 deformable under pressure having a maximum volume in a filled state between 0.5 l and 3 l. The pressure container 110 is preferably slightly larger (for example 10%, 50%, 100% or 200% larger, or more, than the liquid container 102 to be contained) in order to still provide sufficient space for the filling with gas having overpressure, since otherwise, when emptying the liquid container 102, the overpressure of the gas would reduce too sharply and the entire content of the liquid container 102 might not be emptied.

The liquid container 102 deformable under pressure may for example be a conventional disposable drinking pouch or reusable drinking pouch made of plastic. Thin-walled aluminium containers can also be used for example, provided the gas is filled into the interior space 112 of the pressure container 110 with enough overpressure to deform the aluminium container and thus to press the liquid from the aluminium container. The liquid container 102 deformable under pressure is preferably an easily deformable plastic container however, since it can also be ensured in this case that practically the entire liquid can be pressed from the liquid container 102 provided the gas is filled into the interior space 112 of the pressure container 110 with enough overpressure.

The pressure reducer 120 can be implemented in different ways. For example, a conventional pressure reducer with a pressure sensor and a valve can be used, wherein, on the output side above the pressure sensor, the valve is closed increasingly with rising pressure. The pressure on the output side can thus be kept constant or practically constant. A flow limiter is preferably used as a pressure reducer 120 however. A flow limiter is used to control a predefined, constant or practically constant flow of liquid. In other words, the flow limiter may limit a flow of liquids, such that liquid which bears with a first pressure against the first connector 122 of the flow limiter is provided with a second pressure against the second connector 124 of the flow limiter. Here, the first pressure does not have to be constant, but rather is also dependent on the overpressure at which the gas has been filled into the remaining interior space. Here, it is key that, by means of the pressure reducer 120, the liquid is provided with a constant or practically constant second pressure at the second connector 124.

Here, the pressure reducer 120 is not to be confused with a purely in/out valve. In the case of an in/out valve, either no liquid is provided or the liquid is provided in a manner highly dependent on the magnitude of the overpressure in the remaining interior space. This may lead to difficulties when drinking, but also to injuries, if the overpressure is very high.

By contrast, the pressure reducer 120 provides the liquid at constant or practically constant pressure (with a maximum deviation of 20%, 10%, 5% or 1% of the low second pressure), provided the overpressure in the remaining interior space is higher than the pressure at which the pressure reducer provides the liquid. The pressure reducer 120 thus limits the maximum pressure at which the liquid for drinking is provided. For example, the pressure reducer 120 can limit the maximum pressure at which the liquid is provided to 0.4 bar (second pressure), although the overpressure in the interior space (and therefore also of the liquid at the connector of the pressure reducer) is greater than 2 bar for example.

The pressure reducer 120 may be formed for example as a bushing through the pressure container 110, such that no parts (for example drinking tube) outside the pressure container are filled or in contact with the liquid pressurized with the high first pressure. It can thus be ensured that no injuries are sustained, for example as a result of the bursting of a tube under the pressure of the liquid of the high-pressure side.

On the whole, the device can then be produced such that, outside the pressure container, the liquid only has the lower second pressure, and the liquid is pressurized at the high first pressure only inside the pressure container 110.

The valve 130 is used to fill the remaining part of the interior space 112 with gas having overpressure. More specifically, the gas can be drained again from the pressure container 110 via the valve 130, for example in order to replace the liquid container 102. For example, pressurized air provided from a compressor can be used as gas. Alternatively, for example in the diving field, a diving cylinder can be easily connected to the valve 130, and breathing air can thus be filled under pressure into the pressure container 110. The valve 130 can be implemented in various ways. For example, a tire valve (for example a bicycle valve) can be used.

In some exemplary embodiments according to the disclosure, the device 100 additionally comprises a pressure gauge. The pressure gauge can measure a pressure of the gas, pressurized with overpressure, in the interior space 112 of the pressure container 110 and can display the pressure in an externally visible manner. A user can thus identify whether there is still sufficient pressure to obtain liquid. This can be important particularly when under water at great depth. In addition, it is possible to identify before exchanging or refilling the liquid container 102 whether there is still an overpressure in the interior space 112 of the pressure container 110. An example for the implementation of a pressure gauge is described for example in conjunction with FIG. 1*b* (discussed further herein).

Furthermore, the device 100 may optionally comprise a gas outlet valve. The gas outlet valve can let out from the interior space 112 of the pressure container 110 the gas, pressurized with overpressure, in the interior space 112 of the pressure container 110 and can thus adjust to the atmospheric pressure. The pressure container 110 can then be opened for cleaning or for exchange of the liquid container 102. Alternatively, the valve 130 may also be configured to fill the pressure container 110 with gas in order to also let out the gas again. An example for an implementation of a gas outlet valve is described for example in conjunction with FIG. 1*b* (discussed further herein).

In some exemplary embodiments according to the disclosure, a heat-insulated environment is provided for the liquid in a liquid container 102, which is deformable under pressure and is to be contained by the pressure container 110. This can be implemented in different ways. For example, the pressure container 110 may consist at least in part from heat-insulating material. For example, the pressure container 110 may consist of plastic (for example injection-moulded plastic) or may have a multi-layered structure. Alternatively, a device according to the described concept can comprise a heat-insulating layer arranged between an outer wall of the pressure container 110 and a part of the interior space 112 of the pressure container 110 provided for receiving the liquid container 102. For example, the inner wall of the pressure container 110 can be covered with heat-insulating material. The term "heat-insulating" refers here to materials with a coefficient of thermal conduction that is low compared to metal (for example less than 0.01, 0.1 or 0.5 W/mK) or to material layers with a low thermal transmittance (for example less than 0.5, 1, 2, 4 or 10 $W/m^2K$).

In some exemplary embodiments according to the disclosure, the device for providing drinkable liquids also comprises a liquid container 102, which is deformable under pressure and which is connected by means of an opening to the first connector 122 of the pressure reducer 120. Here, the liquid container 102 deformable under pressure can additionally be connected by means of a second opening (next to the opening for connection to the pressure reducer) to a closable opening in the pressure container 110, such that the liquid container 102 deformable under pressure can be filled with a drinkable liquid via the closable opening of the pressure container 110. The liquid container 102 can also be cleaned via this opening.

Figure 3:
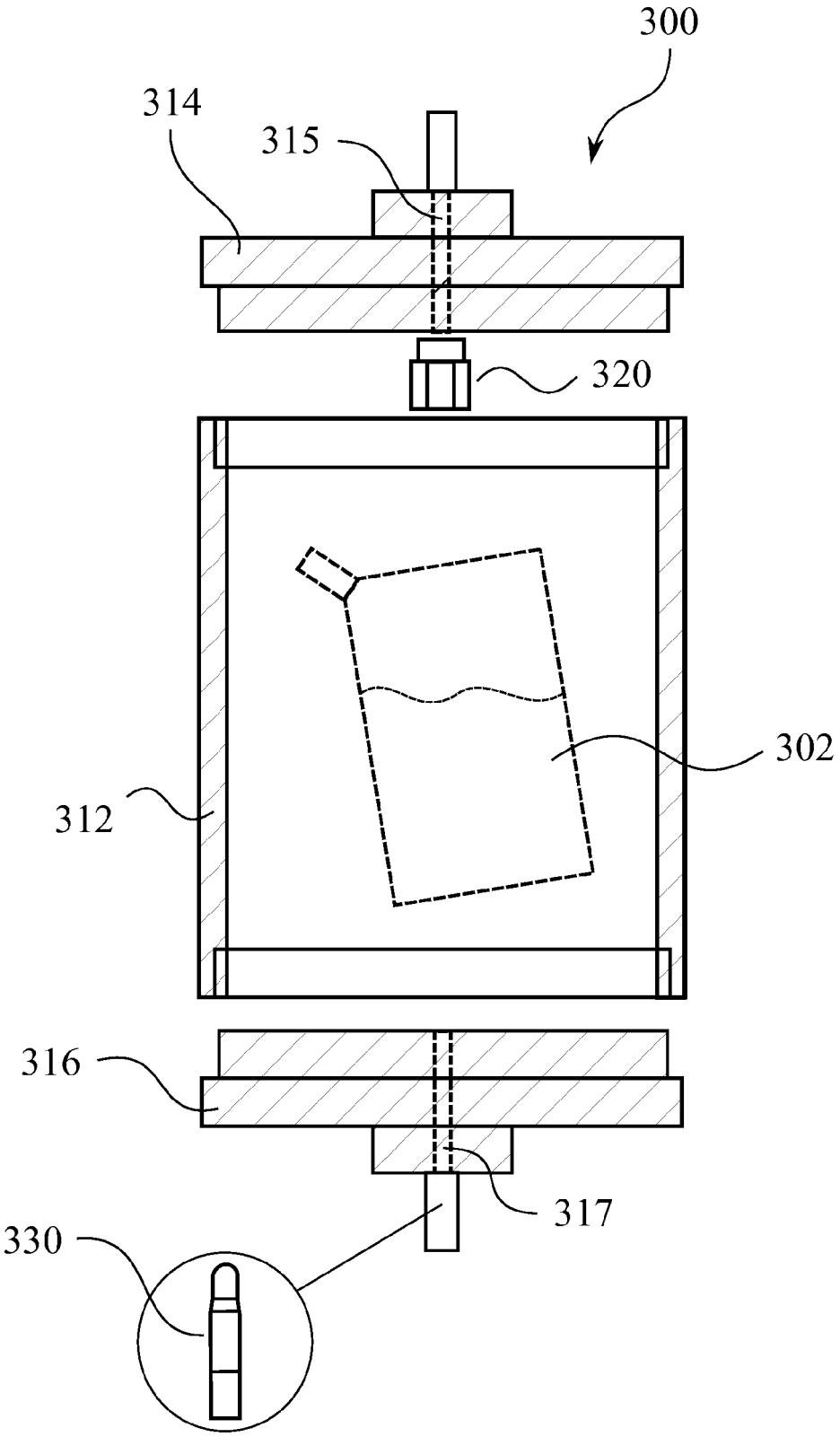
FIG. 3 shows a schematic illustration of the components of a device for providing drinkable liquids.

A specific example for a possible implementation of the described concept is shown in FIG. 3. The device 300 comprises a tubular part 312, a first cover at 314, and a second cover 316, which together form a pressure container. The two covers can be screwed in a pressure-tight manner to the tubular part 312 via a fine thread for example. The two covers can thus be removed reversibly from the tubular part 312, for example in order to exchange the liquid container 302 deformable under pressure (for example a standard drinking pouch) or in order to clean the pressure container. The first cover 314 comprises a bushing 315, at the inner end of which the pressure reducer 320 is arranged and at the outer end of which a connector for a drinking tube is arranged. The liquid container 302 can be connected to a connector of the flow limiter. The second cover 316 comprises a bushing 317, at the outer end of which the valve 330 (for example, a bicycle valve or a standard Woods valve or Dunlop valve) is arranged. Alternatively, the valve 330 may also be arranged at the inner end of the bushing or may form the bushing itself.

Alternatively, the second cover 316 can also be rigidly connected to the tubular part 312, since it is also sufficient to open one side in order to exchange the liquid container 302 and in order to clean the pressure container.

In other words, the pressure container may comprise a tubular part 312, a first cover 314, and a second cover 316, wherein a first end of the tubular part 312 can be closed reversibly in a pressure-tight manner by the first cover 314, and a second end of the tubular part 312 can be closed or is closed in a pressure-tight manner by the second cover.

Possible dimensions to achieve a volume of 1.5 l would be, for example, a length of approximately 30 cm, a height of approximately 10 cm, and a width of approximately 15 cm. Alternatively, a circular cross section with a diameter of approximately 10 cm and a height of 30 cm is also possible for example.

Fastening to the diving cylinder, for example below the fastening device of the safety jacket, by tension belt is also possible for example.

Figure 4:
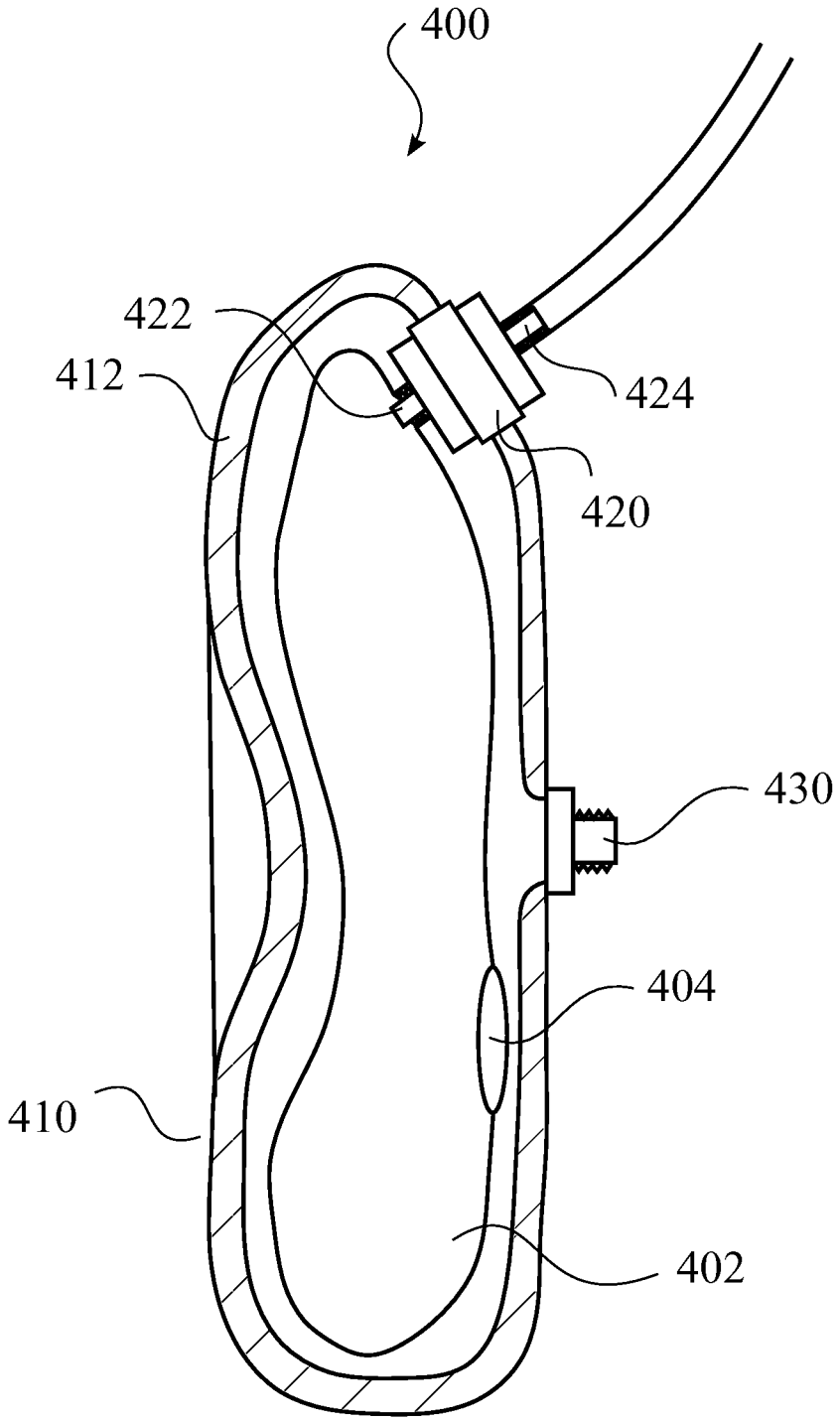
FIG. 4 shows a schematic cross section of a device for providing drinkable liquids.

A further exemplary embodiment is shown in FIG. 4. The drinking container 400 comprises a pressure container 410 with heat insulation 412. The heat insulation lines the outer shells on the inner wall. In an application in the diving field, the material may vary depending on the predominant depth range. The drinking bladder 402 (the liquid container deformable under pressure) may have a capacity for example of approximately 0.75 l (for example without carbon dioxide). Furthermore, the drinking bladder 402 has an opening hatch 404 with screw closure for filling and cleaning the drinking bladder 402. The pressure reducer 420 may comprise an adapter piece 422, for example on its first connector in the interior space of the pressure container 410, for connection of the drinking bladder 402 to the pressure reducer 420. Directed outwardly, the pressure reducer 420 may comprise a connector 424 for a drinking tube. The drinking tube can be additionally sheathed for example for thermal insulation. Furthermore, a valve 430 for the filling system is shown.

Figure 5:
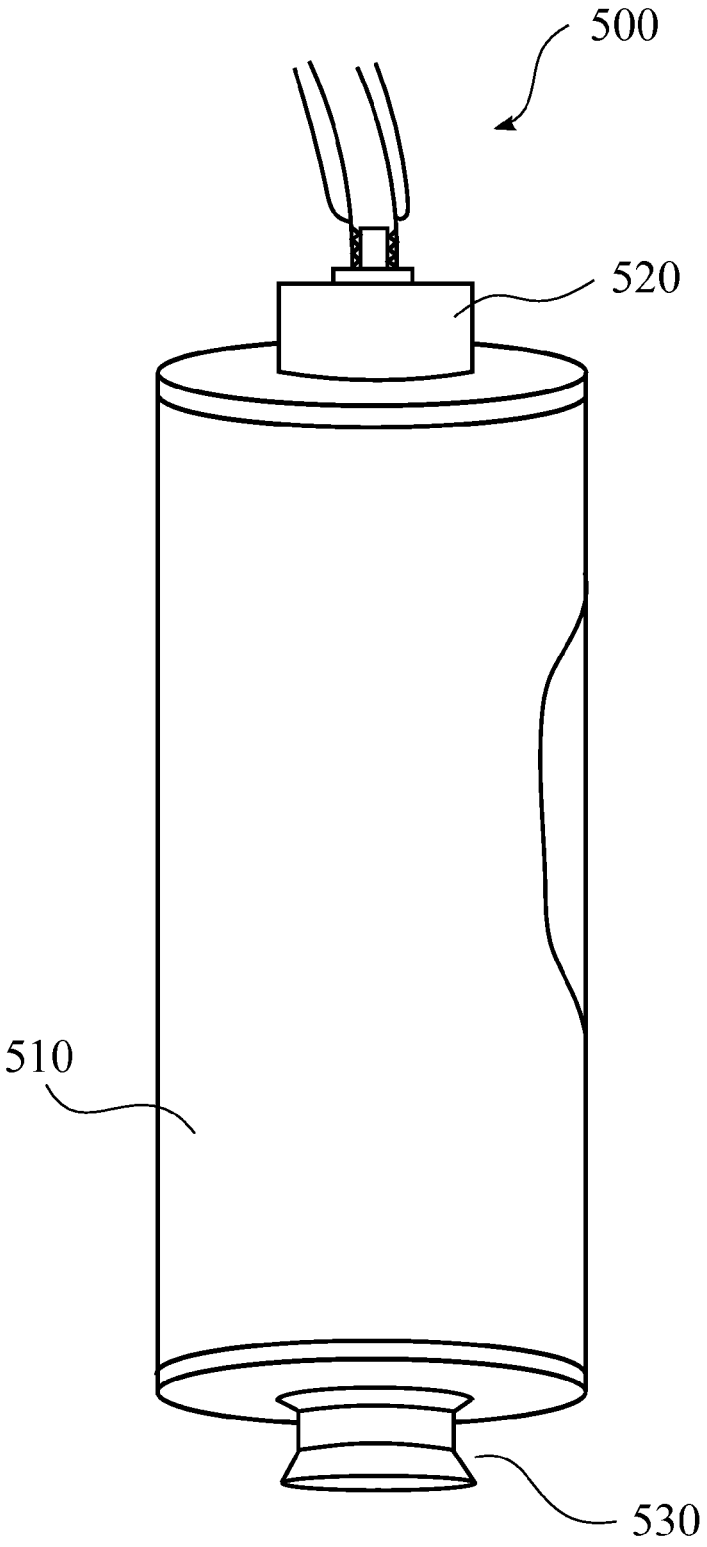
FIG. 5 shows a schematic side view of a device for providing drinkable liquids.

Another exemplary embodiment according to the disclosure is shown in FIG. 5. Here, the drinking container 500 comprises a pressure container 510 (for example formed from a cylindrical aluminium tube or plastic) with a recess for receiving fastening belts, for example for fastening to a diving cylinder. A pressure reduction valve 520 with a connector for receiving a drinking tube (for example insulated) is arranged at one end of the cylindrical pressure container 510. At this end, the cover can be provided with a screw closure in order to remove the cover. In the open state, the drinking bladder can then be filled for example and the drinking bladder can be fitted to the pressure reduction valve. The other side of the cylindrical pressure container 510 can likewise be provided with a cover with screw closure in order to remove the base or to remove the insides. In the open state, the drinking container can be cleaned and/or a safety check can be performed. The air inlet valve for filling the air bladder, which then presses onto the drinking bladder in order to squeeze out the liquid, is arranged on this side.

Figure 6:
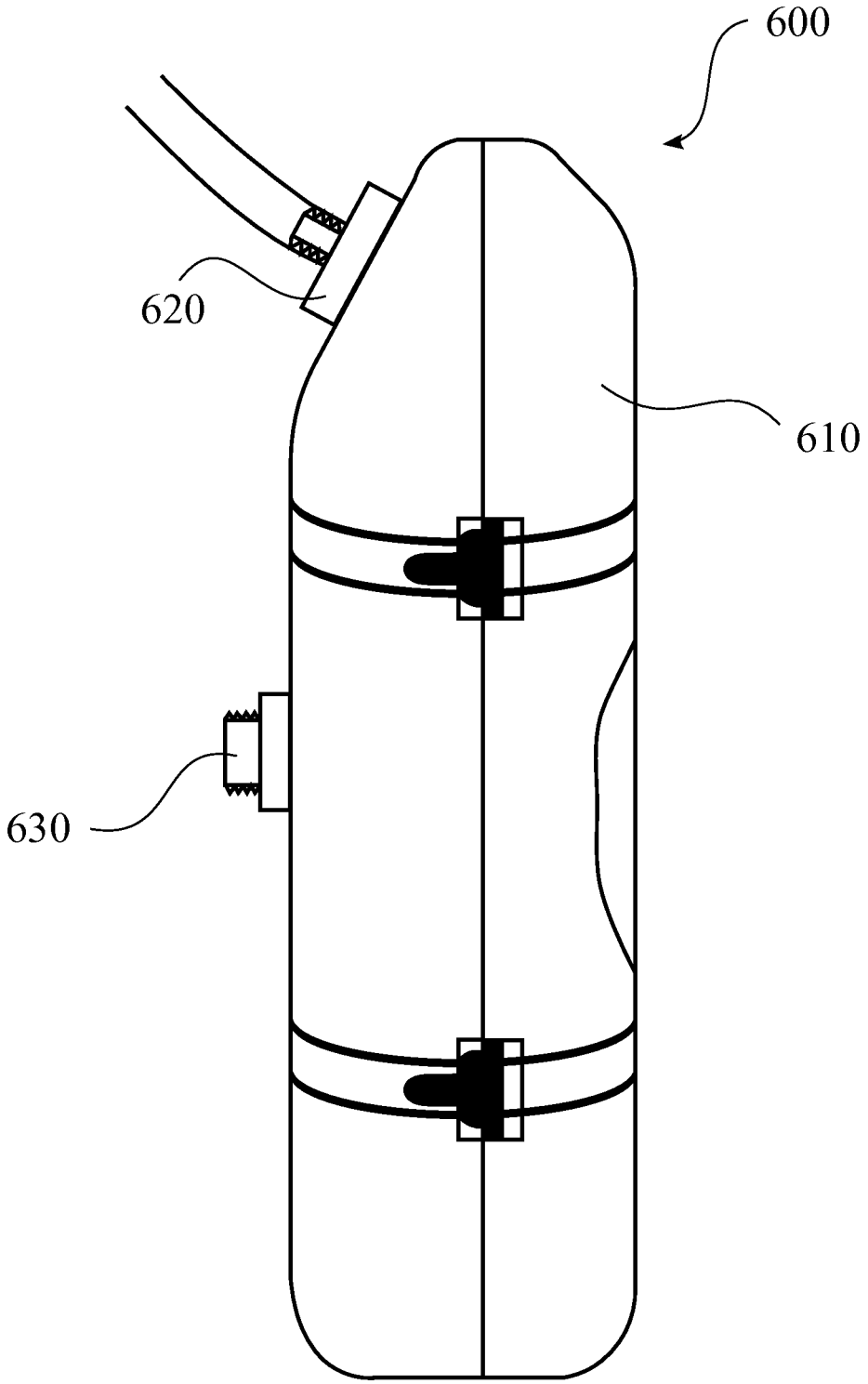
FIG. 6 shows a schematic side view of a further device for providing drinkable liquids.

Some exemplary embodiments according to the disclosure concern a device 600 comprising a pressure container 610, which is formed in two parts. The two parts of the pressure container 610 can be closed via a closure system in a pressure-tight manner with respect to the gas having overpressure, as is shown for example in FIG. 6. The pressure container 610 consists here of an upper shell (for example made of carbon in order to achieve heat insulation for warm liquids for 2 h for example) and a lower shell (for example likewise made of carbon in order to achieve heat insulation for 2 h for example). The closure system can be formed for example in accordance with the tension belt principle. For example, a 360° rubber seal, which internally withstands up to or above 2, 3, or 5 bar, and externally withstands up to or above 7, 10, or 15 bar, can be arranged between the upper shell and lower shell of the pressure container 610. The upper shell and the lower shell may additionally engage in one another for example by means of closure grooves and may thus be sealed one hundred percent (external pressure). A safety fixing can be achieved by the closure system. Furthermore, a pressure reducer 620 or pressure reduction valve for uniform liquid supply at any moment and for receiving a drinking tube is shown for example. The tank tube 640 can be provided with a neoprene sheathing for purposes of heat insulation. Furthermore, a filling valve 630 for generating the inner overpressure of approximately 1 to 2 bar or more is shown. The filling process can be carried out for example by means of breathing air or compressed air from the safety jacket. The pressure container 610 may in turn comprise a recess for receiving a fastening belt for fastening to the diving cylinder.

Figure 7:
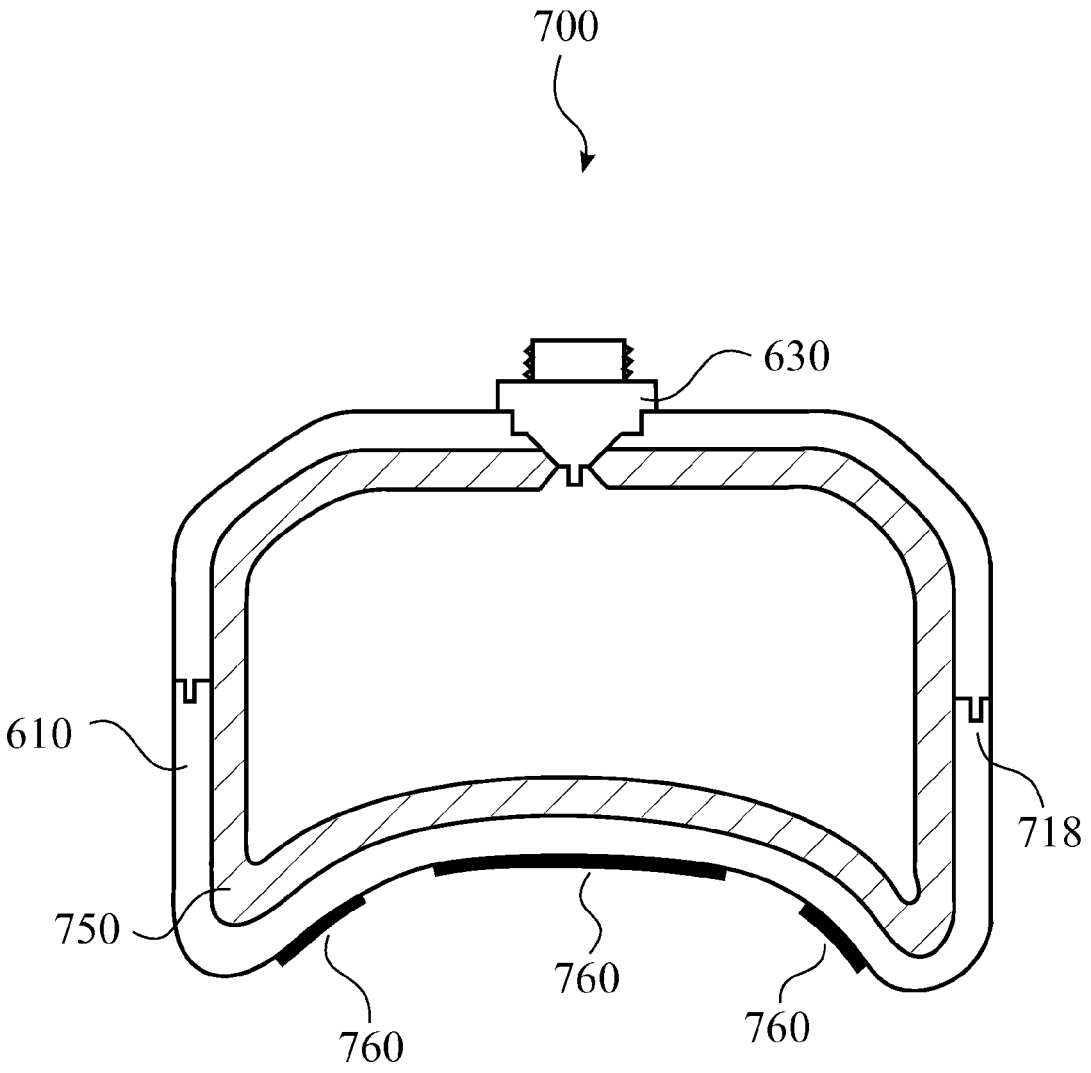
FIG. 7 shows a schematic cross section of a device for providing drinkable liquids.

FIG. 7, in a complementary manner, shows a cross section of the drinking container 700. Here, the filling valve 630 and also the closure grooves 718 engaging in one another and a rubber seal are shown. The inner wall of the pressure container 610 is lined by heat insulation 750. The pressure container 610 has a shape on one side, the shape being matched to a periphery of a diving cylinder or oxygen cylinder. To this end, a rubber coating 760 for contact with the oxygen cylinder is provided for fixing and for protecting both modules.

In some exemplary embodiments according to the disclosure, the device for providing drinkable liquids comprises a gas container, which is deformable under pressure, in the interior space of the pressure container, the gas container being connected by means of an opening to the valve and forming the part of the interior space of the pressure container that can be filled with a gas having an overpressure, such that the gas container deformable under pressure, once filled with gas having overpressure, exerts a pressure as a result of its expansion onto a liquid container, which is deformable under pressure and can be contained by the pressure container. In other words, due to the gas pressurized with overpressure in its interior, the gas container presses directly or indirectly onto the liquid container, whereby the liquid in the container bears with pressure against the pressure reducer.

Figure 8:
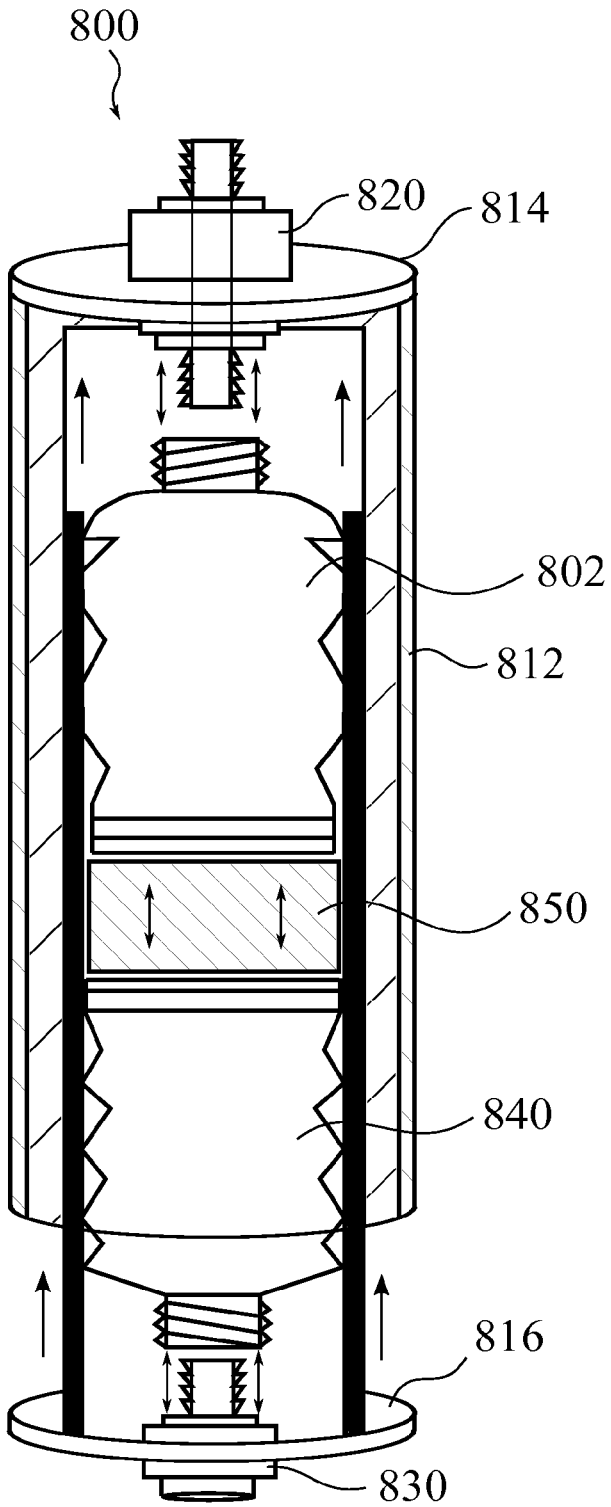
FIG. 8 shows a schematic cross section of a further device for providing drinkable liquids.

A specific example of this is shown in FIG. 8. The drinking container 800 comprises a cylindrical pressure container, which comprises a tubular part 812 (for example aluminium tube) with heat insulation, a first cover 814 with a pressure reduction valve 820, and a second cover 816 with a valve 830. The upper closure clover 814 can be configured for example to be screwed in a pressure-tight manner to the tubular part 812 of the pressure container. Furthermore, it can be configured on the outer face to contain a drinking tube. A click valve system for connection of the pressure reducer 820 to the liquid container 802 deformable under pressure (for example a drinking bottle or compressable drinking bladder) may be provided on the inner face. Furthermore, a gas container 840 deformable under pressure (also referred to in this context as an air bladder) is arranged in the interior space of the pressure container and is connected by means of an opening to an inner connector of the valve 830. The gas container 840 can thus be filled with air via the valve. The gas container 840 can press directly against the liquid container 802 or can be separated from the liquid container 802 by a spacer 850 and can exert pressure onto the liquid container 802 indirectly via the spacer 850, as is shown in FIG. 8. The second cover 816 or the base of the drinking container (drinking bottle) can be connected to an inner tube and introduced as an entire element with the air bladder 840 and the spacer 850 into the outer aluminium tube (the tubular part of the pressure container) and connected securely and tightly to the outer body by means of a screw closure. Air can infiltrate from outside (via the valve), such that the air bladder 840 can be filled with air. The air bladder 840 thus expands (cylindrically) (upwardly) and thus presses onto the isolated spacer 850 and therefore the drinking bladder (liquid container). Pressure is thus applied permanently to the liquid outlet valve (pressure reduction valve). The tubular part 812 (for example aluminium tube) can equally be used for insulation, for stability and for safety, and may also ensure a controlled guidance of the spacer 850, the air bladder 840 and the drinking bladder 802.

Figure 2A:
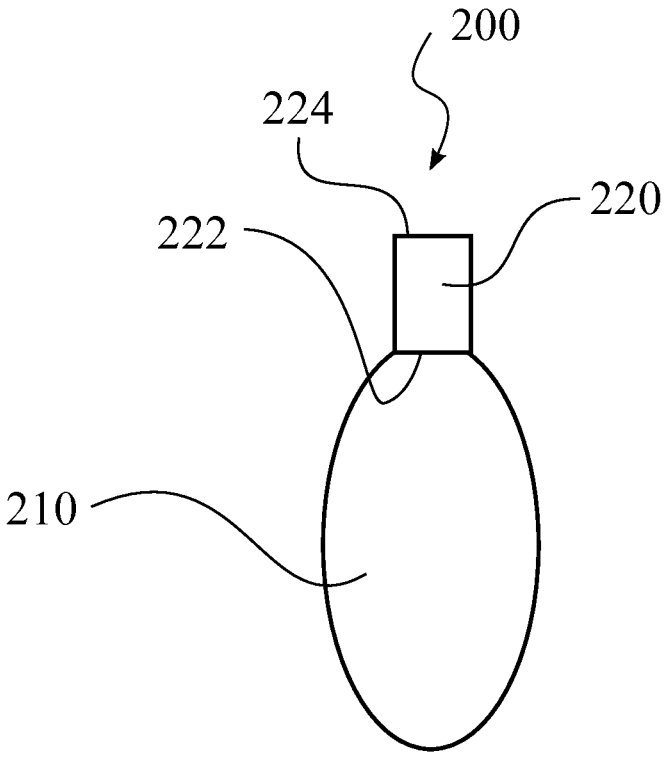
FIG. 2*a* shows schematic cross section of a further device for providing drinkable liquids with an unfilled liquid container.
Figure 2B:
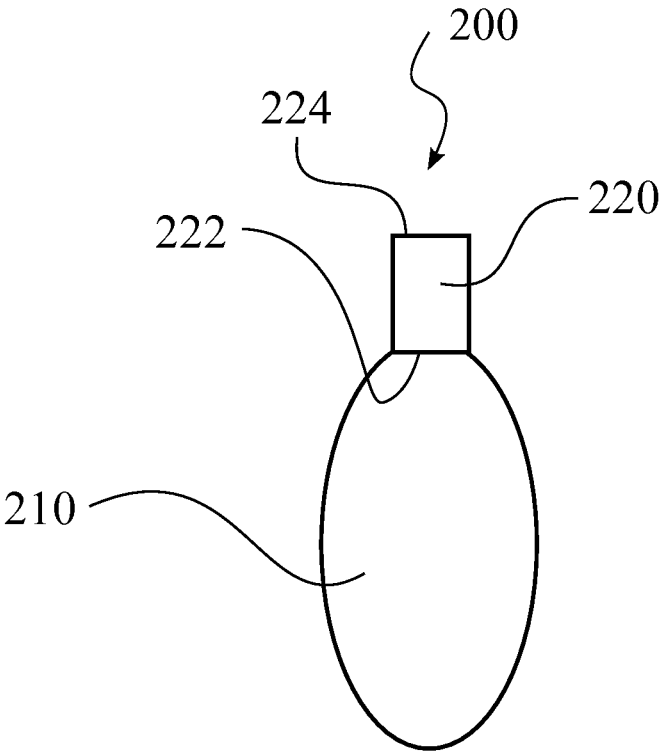
FIG. 2*b* shows a schematic cross section of the device for providing drinkable liquids from FIG. 2*a* with a liquid container in a filled state.

FIGS. 2*a* and 2*b* show a schematic illustration of a device 200 for providing drinkable liquids underwater corresponding to an exemplary embodiment according to the disclosure. The device 200 comprises a liquid container 210 and a pressure reducer 220. The liquid container 210 consists at least in part of elastic material and can be filled with a drinkable liquid, such that the elastic material of the liquid container 210 is expanded. The pressure reducer 220 provides a liquid which bears with a first pressure against a first connector 222 of the pressure reducer 220 with a second pressure at a second connector 224 of the pressure reducer 220. Here, the first pressure is higher than the second pressure. The liquid container 210 is connected by means of an opening to the first connector 222 of the pressure reducer 220. The liquid container 210 is configured here to provide, in an expanded state of the elastic material (in a filled state), a drinkable liquid with the first pressure at the first connector 222 of the pressure reducer 220.

Here, the first pressure is normally dependant on the magnitude of the expansion of the elastic material of the liquid container 210. Normally, the more severely the material is expanded, the higher is the first pressure. Here, by means of the pressure reducer 220, the liquid from the liquid container 210 is provided with a constant or practically constant lower second pressure at the second connector 224 of the liquid container, independently or practically independently of the first pressure.

The liquid container 210 may consist for example completely or in part of rubber, which, in the expanded state, delivers the liquid with an expansion-dependant pressure at its opening.

In FIG. 2*a*, the device 200 is shown in an unfilled state (or in a partially filled state) of the liquid container 210. By filling the liquid container 210 with drinkable liquid, the elastic material expands, as is shown in FIG. 2*b*, whereby restoring forces are produced, which exert a pressure onto the contained liquid.

The device 200 can be extended by one or more further optional features, which correspond to the previously described aspects.

Compared to the previously described exemplary embodiments, in this example not all of the liquid can normally be pressed again from the liquid container 210, for which reason the structure is considerably simpler. The underlying principle by contrast is that the same liquid, that is to say a liquid pressurized with high pressure, can be delivered with a desired constant or practically constant pressure in order to enable easy drinking of the liquid.

Figure 1B:
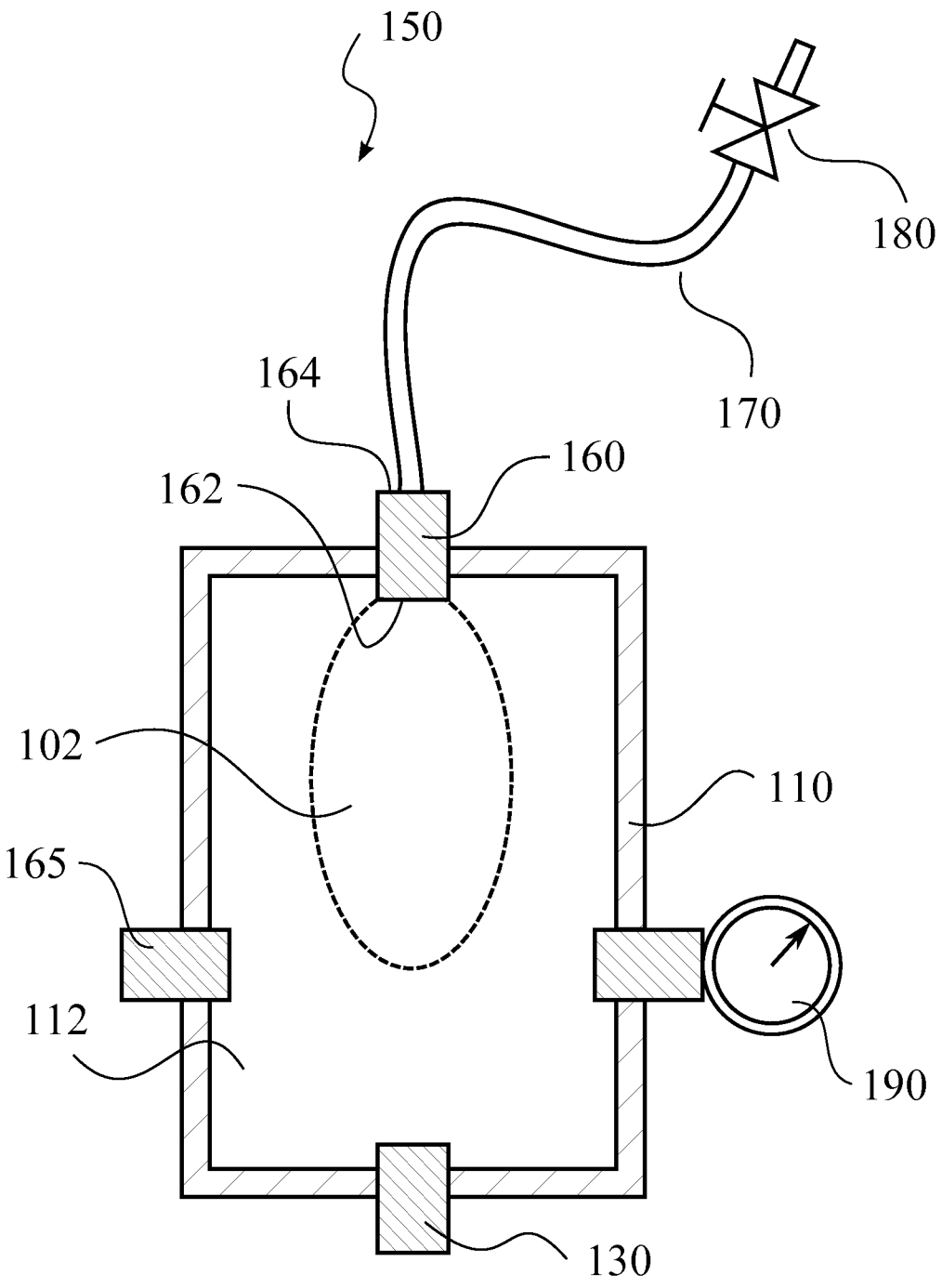
FIG. 1*b* shows a schematic cross section of a device for providing drinkable liquids.

FIG. 1*b* shows a schematic illustration of a device 150 for providing a drinkable liquid corresponding to an exemplary embodiment according to the disclosure. The device 150 comprises a pressure container 110, a flow limiter 160, a drinking tube 170 with a device for activating a liquid delivery 180, and a valve 130. The pressure container 110 is configured to contain a liquid container 102, which is deformable under pressure, in an interior space 112. Furthermore, the flow limiter 160 is arranged such that a first connector 162 of the flow limiter 160 is connectable to a liquid container 102, which is deformable under pressure, in the interior space 112 of the pressure container 110, and a second connector 164 of the flow limiter 160 is accessible from outside the pressure container 110. The drinking tube 170 is connected at one end to the second connector 164 of the flow limiter 160 and, at a second end, comprises a device for activating a liquid delivery 180. The flow limiter 160 is also configured to provide a liquid which bears with a (first) pressure against the first connector 162 of the flow limiter 160 with a predefined flow rate at the second connector 164 of the flow limiter 160 when the liquid delivery is activated by the device for activating a liquid delivery 180. The valve 130 is used to fill with a gas at least part of a part of the interior space 112 of the pressure container 110 remaining after receipt of a liquid container 102 deformable under pressure, the pressure having an overpressure, such that a liquid in a liquid container 102 deformable under pressure bears with the (first) pressure against the flow limiter 160.

Due to the use of a flow limiter 160, a drinkable liquid from a liquid container 102 can be provided at a constant or practically constant flow rate by the flow limiter 160, independently or practically independently of the pressure (first pressure) of the liquid in the liquid container 102. To this end, the liquid in the liquid container 102 must only have at least a minimum pressure determined by the selection of the flow limiter 160, it being possible however for the minimum pressure to be determined by the selection of the magnitude of the overpressure of the gas to be introduced via the valve 130.

The predefined flow rate can be determined by the specific selection of the flow limiter 160. For example, a constant or practically constant liquid delivery of 2 l/min, 3 l/min, 4 l/min, 5 l/min or another desired value can thus be achieved.

Furthermore, the device 150 may optionally comprise a pressure gauge 190. The pressure gauge 190 can measure a pressure of the gas, pressurized with overpressure, in the interior space 112 of the pressure container 110 and can display this pressure in an externally visible manner. A user can thus identify whether there is still sufficient pressure to obtain liquid. This may be important in particular under water at great depths. In addition, it is possible to identify before exchanging or refilling the liquid container 102 whether an overpressure still prevails in the interior space 112 of the pressure container 110.

In addition, the device 150 may optionally comprise a gas outlet valve 165. The gas outlet valve 165 can let out from the interior space 112 of the pressure container 110 the gas, pressurized with overpressure, in the interior space 112 of the pressure container 110 and can thus adjust to the atmospheric pressure. The pressure container can then be opened for cleaning or for exchange of the liquid container. Alternatively, the valve 130 for filling the pressure container with gas can also be configured to also let out the gas again.

The device 150 may also be extended by one or more further optional features, which correspond to the previously described aspects.

Independently of the specific implementation as has been described above in the numerous exemplary embodiments, the second pressure may be less than 0.4 bar for example in order to ensure the greatest possible drinking comfort. By contrast, the first pressure may be greater than 2 bar for example in order to be able to empty the liquid container fully or practically fully.

Figure 9:
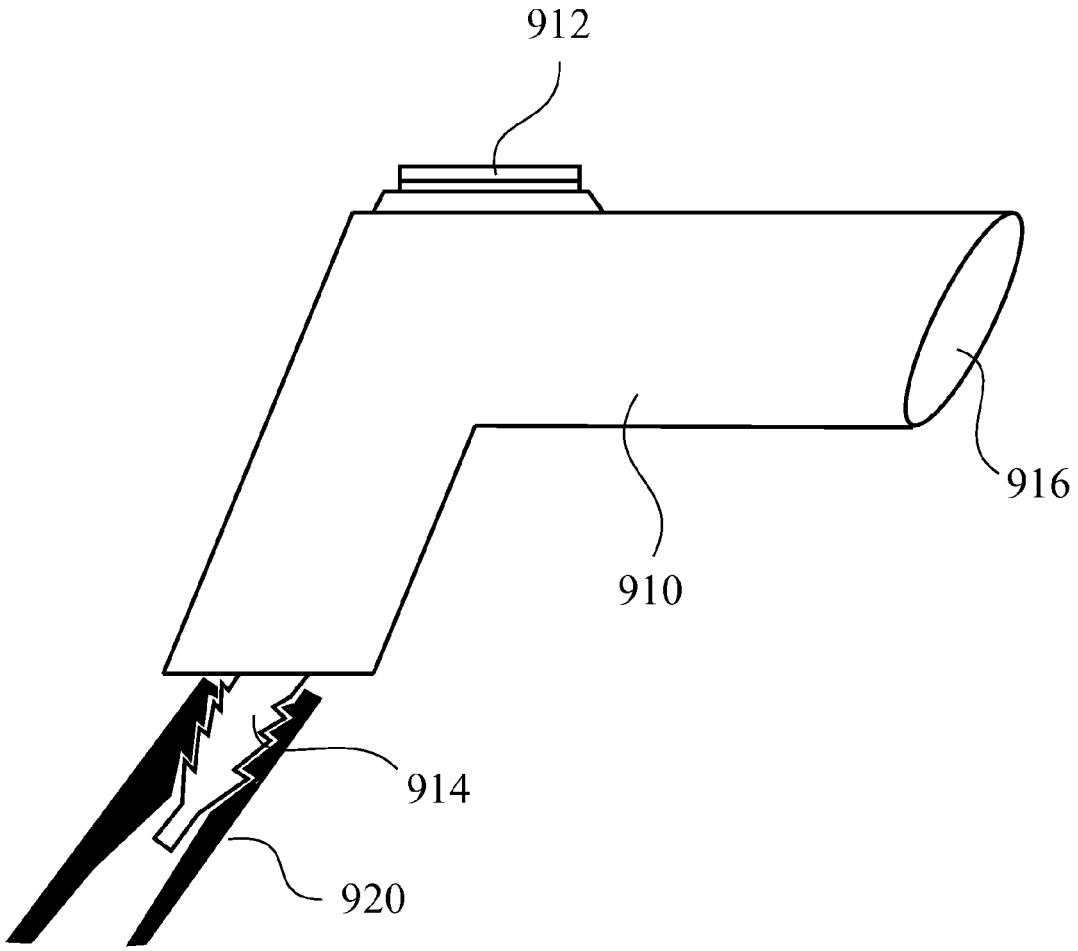
FIG. 9 shows a schematic illustration of a drinking tube with a device for activating a liquid delivery.

In addition, a device for providing a drinkable liquid may comprise a drinking tube, which is connected at one end to the second connector of the pressure reducer and, at a second end, comprises a device for activating a liquid delivery. An example of a drinking tube and of a device for activating a liquid delivery is shown in FIG. 9. Here, the device 910 for activating a liquid delivery has a pressure trigger mechanism 912 for metering the liquid and a connector 914 for receiving the drinking tube 920. A diver for example can place his lips around the liquid outlet 916. The liquid escapes by itself due to the action of the overpressure on the drinking bladder (liquid container). The liquid is only metered for example by the valve. Alternatively, the device for activating a liquid delivery may also comprise a rotary valve for example for activating and deactivating the liquid delivery.

Figure 10:
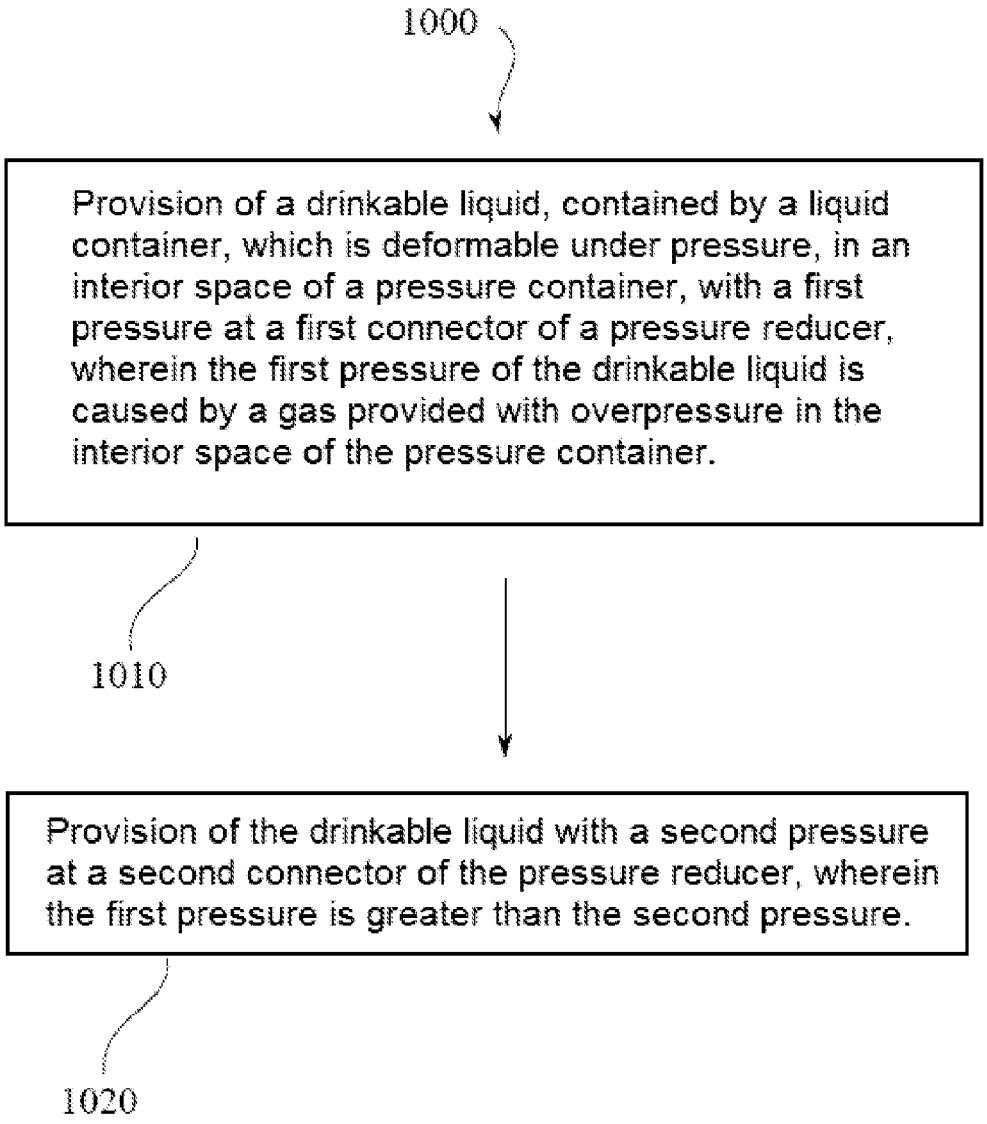
FIG. 10 shows a flow diagram of a method for providing drinkable liquids.

FIG. 10 shows a flow diagram of a method 1000 for providing a drinkable liquid in accordance with an exemplary embodiment according to the disclosure. The method 1000 comprises a provision 1010 of a drinkable liquid, contained by a liquid container, which is deformable under pressure, in an interior space of a pressure container, with a first pressure at a first connector of a pressure reducer. Here, the first pressure of the drinkable liquid is caused by a gas provided with overpressure in the interior space of the pressure container. Furthermore, the method 1000 comprises a provision 1020 of the drinkable liquid with a second pressure at a second connector of the pressure reducer, wherein the first pressure is greater than the second pressure.

The method 1000 may also additionally comprise further optional steps, which correspond to the various aspects of the previously described exemplary embodiments.

The described concept provides a possibility of creating a device for providing drinkable liquids or drinking vessels, particularly for use underwater. These can be used for example for diving sessions of any type. The depth at which the device can be used may be made dependent here on the insulating material, or different insulating material can be used for applications at different depths, although in principle drinking vessels of this type are suitable for any depth (for example standard device up to 60 m) and any type of water.

The pressure container or the upper shell and lower shell of the pressure container may consist for example of injection-moulded plastic, aluminium or Kevlar. The tension belt closure system can be fabricated from plastic or from material for safety belts. The pressure reduction valve (the pressure reducer), the filling valve (the valve), the connector for the liquid container (for example adapter piece that connects the drinking bladder and the pressure reducer) and/or the connector for the drinking tube (drinking tube receptacle) may consist for example of food-grade metal (metal that can be used in food preparation), and the liquid container (for example the drinking bladder with hatch, standard 0.75 l) and the drinking tube may also consist of food-grade plastic. The drinking tube insulation may be made of neoprene for example. The valve for liquid supply (at the end of the drinking tube) and a clip for fastening the drinking tube may consist of plastic for example. The heat insulation can be produced for example by insulation mats or insulation foam.

Although some aspects have been described in conjunction with a device, it goes without saying that these aspects also constitute a description of the corresponding method, and therefore a block or a component of a device is also to be understood as a corresponding method step or as a feature of a method step. Similarly, aspects that have been described in conjunction with a method step or as a method step also constitute a description of a corresponding block or detail or feature of a corresponding device.

The above-described exemplary embodiments merely constitute an illustration of the principles of the present disclosure. It goes without saying that modifications and variations of the arrangements and details described herein are obvious to other professionals. It is therefore intended for the disclosure to be limited merely by the scope of protection of the claims hereinafter and not by the specific details that have been presented herein on the basis of the description and the explanation of the exemplary embodiments.

The invention claimed is:

1. A device for providing a drinkable liquid, the device comprising:

a pressure container, which is configured to contain a liquid container, which is deformable under pressure, in an interior space thereof;

a pressure reducer, which is configured to provide a liquid which bears with a first pressure against a first connector of the pressure reducer and which bears with a second pressure at a second connector of the pressure reducer, wherein the first pressure is higher than the second pressure, wherein the pressure reducer is arranged such that the first connector of the pressure reducer is connectable to a liquid container in the interior space of the pressure container, and the second connector of the pressure reducer is accessible from outside the pressure container; and a valve for filling with a gas at least a part of the interior space of the pressure container remaining after receipt of the liquid container, the gas comprising an overpressure, such that liquid in the liquid container bears with the first pressure against the pressure reducer.

2. The device according to claim 1, further comprising a heat-insulating layer, which is arranged between an outer wall of the pressure container and a part of the interior space of the pressure container provided for receiving the liquid container.

3. The device according to claim 1, wherein at least part of the pressure container includes heat-insulating material.

4. The device according to claim 1, wherein the pressure container is configured to receive the liquid container, which is deformable under pressure and has a maximum volume in a filled state between 0.5 l and 3 l.

5. The device according to claim 1, wherein the pressure container is formed in two parts, wherein the two parts of the pressure container can be closed via a closure system in a pressure-tight manner with respect to the gas having overpressure.

6. The device according to claim 1, wherein the pressure container comprises a tubular part, a first cover, and a second cover, wherein a first end of the tubular part can be closed reversibly in a pressure-tight manner by the first cover, and second end of the tubular part can be closed or is closed in a pressure-tight manner by the second cover, wherein the first cover comprises the pressure reducer and the second cover comprises the valve.

7. The device according to claim 1, wherein the liquid container is connected to the first connector of the pressure reducer by means of an opening.

8. The device according to claim 1, wherein the liquid container deformable under pressure is connected by means of an opening to a closable opening of the pressure container, such that the liquid container deformable under pressure can be filled via the closable opening of the pressure container with a drinkable liquid.

9. The device according to claim 1, wherein the valve is a tire valve.

10. The device according to claim 1, further comprising a drinking tube, which is connected at one end to the second connector of the pressure reducer and, at a second end, comprises a device for activating a liquid delivery.

11. The device according to claim 1, wherein the pressure reducer is a flow limiter, which is configured to limit a flow rate of liquids, such that liquid which bears with the first pressure against the first connector of the flow limiter is provided with the second pressure at the second connector of the flow limiter.

12. The device according to claim 1, wherein the first pressure is greater than 2 bar.

13. The device according to claim 1, further comprising a pressure gauge that is configured to measure a pressure of the gas, pressurized with overpressure, in the interior space of the pressure container and to display the pressure in an externally visible manner.

14. The device according to claim 1, further comprising a gas outlet valve that is configured to let out gas, which is pressurized with overpressure, from the interior space of the pressure container.

15. The device according to claim 1, wherein the second pressure is less than 0.4 bar.

16. The device according to claim 1, wherein the device is a drinking container for use underwater.

17. A device for providing a drinkable liquid, the device comprising:

a pressure container, which is configured to contain a liquid container, which is deformable under pressure, in an interior space thereof;

a flow limiter, which is arranged such that a first connector of the flow limiter is connectable to a liquid container in the interior space of the pressure container, and a second connector of the flow limiter is accessible from outside the pressure container;

a drinking tube, which is connected at one end to the second connector of the flow limiter and, at a second end, comprises a device for activating a liquid delivery, wherein the flow limiter is configured to provide a liquid which bears with a first pressure against the first connector of the flow limiter at a predefined flow rate at the second connector of the flow limiter when the liquid delivery is activated by the device for activating a liquid delivery; and a valve for filling with a gas at least a part of the interior space of the pressure container remaining after receipt of the liquid container, the gas having an overpressure, such that liquid in the liquid container bears with the first pressure against the flow limiter.

* * * * *